United States Patent [19]

Cislo

[11] Patent Number: 5,009,088

[45] **Date of Patent: * Apr. 23, 1991**

[54] MODULAR LOCKBOX AND CARRYING CASE FOR PISTOLS

[76] Inventor: Daniel M. Cislo, 3413 Rambla Pacifico, Malibu, Calif. 90265

[ * ] Notice: The portion of the term of this patent subsequent to Jan. 2, 2007 has been disclaimed.

[21] Appl. No.: 446,330

[22] Filed: Dec. 4, 1989

Related U.S. Application Data

[63] Continuation-in-part of Ser. No. 253,581, Oct. 5, 1988, Pat. No. 4,890,466, which is a continuation-in-part of Ser. No. 19,518, Feb. 26, 1987, Pat. No. 4,788,838.

[51] Int. Cl.[5] ..... E05B 65/52

[52] U.S. Cl. ..... 70/63; 109/51

[58] Field of Search ..... 70/63, 67, 69; 109/51, 109/68, 69; 312/209, 204; 5/503, 507, 508

[56] References Cited

U.S. PATENT DOCUMENTS

| | | | |
|---|---|---|---|
| 4,155,608 | 5/1979 | Orlevicz | 109/51 |
| 4,348,967 | 9/1982 | Schattner | 109/51 |
| 4,663,621 | 5/1987 | Field | 312/209 |
| 4,768,021 | 8/1988 | Ferraro | 70/63 |
| 4,788,838 | 12/1988 | Cislo | 70/63 |
| 4,807,315 | 2/1989 | Wachenheim | 109/68 |
| 4,890,466 | 1/1990 | Cislo | 70/63 |

*Primary Examiner*—Robert L. Wolfe

*Attorney, Agent, or Firm*—Cislo & Thomas

[57] ABSTRACT

An improved apparatus to lock a handgun within a compartment while the compartment is readily lockable to a stationary object using a clip. The compartment is only accessible by authorized persons to unlock a latch to open the compartment. The latch can be lighted to allow entry at night. The apparatus also serves to carry the handgun and can subsequently be used to so secure the handgun at another location.

22 Claims, 5 Drawing Sheets

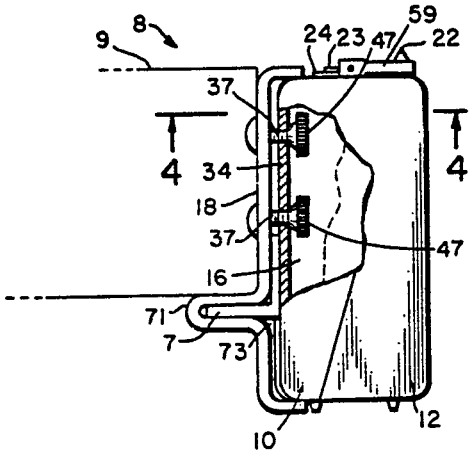
Fig. 2.
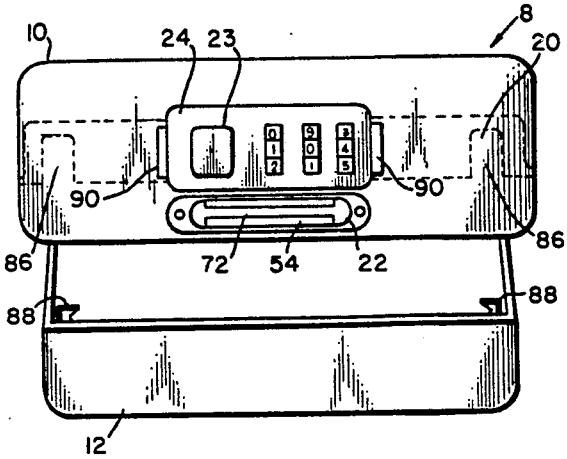
Fig. 3.
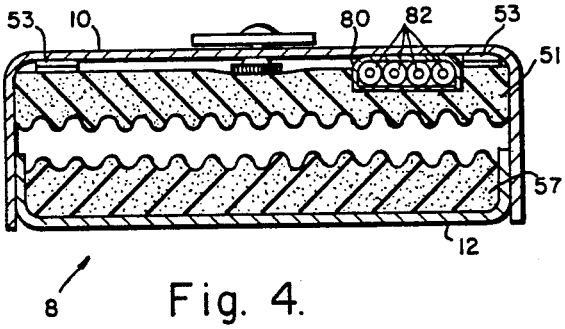
Fig. 4.
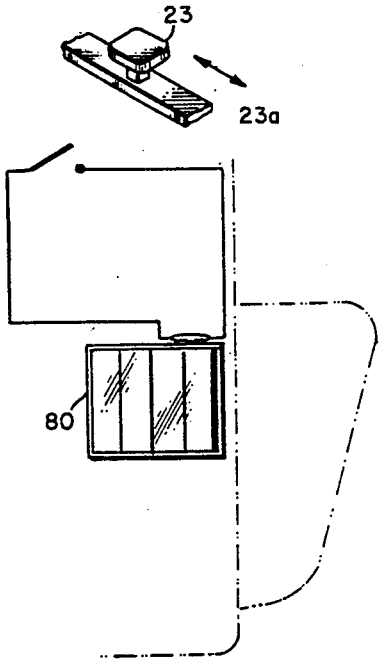
Fig. 5.
Fig. 6.
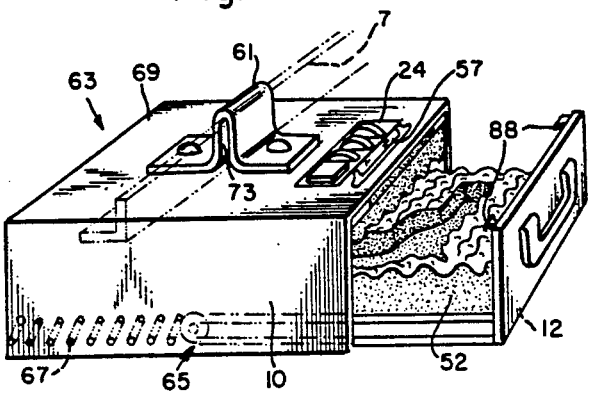

MODULAR LOCKBOX AND CARRYING CASE FOR PISTOLS

This application is a continuation-in-part of an earlier filed patent application entitled IMPROVE LOCKBOX AND CARRYING CASE FOR PISTOLS, application Ser. No. 07/253,581, and now U.S. Pat. No. 4,890,466, filed Oct. 5, 1988, which is a continuation-in-part application of an earlier filed patent application Ser. No. 019,518 entitled GUARDIAN LOCK BOX FOR PISTOLS which issued as U.S. Pat. No. 4,788,838 on Dec. 6, 1988, filed Feb. 26, 1987.

BACKGROUND OF THE INVENTION

This invention relates generally to improved handgun safety mechanisms, and, more particularly, to a handgun lockbox and case for securely storing and carrying a handgun while still making it accessible.

Handgun safety mechanisms vary in type, complexity, and effectiveness. Such mechanisms typically comprise locking means which fit around the trigger guard of a handgun. The locking means prevents access to the trigger and locks the trigger in a set position relative to the handgun's trigger guard. For many guns, this effectively prevents the trigger and hence the hammer or firing means from moving. This prevents accidental firing of the weapon when the mechanism is properly used.

However, other handguns have firing pins or hammers which if jarred can accidentally fire the weapon in the event it is loaded. Therefore, use of these locking mechanisms for safely storing a handgun is only advisable if the gun is unloaded. Additionally, those safety devices do not prevent the handgun from being carried away, nor protect the handgun from nicks and scratches.

Locking cases or strongboxes are other alternatives gun owners have available. These options have mechanisms which are locked and unlocked by the use of a key which must be available to access the gun. Usually the key is located in a different area for security reasons.

Other locking devices are disclosed in U.S. Pat. Nos. 4,807,315 issued Feb. 28, 1989; 4,788,838 issued Dec. 6, 1988; 4,768,021 issued Aug. 30, 1988; 4,663,621 issued May 5, 1987; 4,573,332 issued Mar. 4, 1986; 4,532,783 issued Aug. 6, 1985; 4,474,116 issued Oct. 2, 1984; 4,348,967 issued Sept. 14, 1982; 4,155,608 issued May 22, 1979; 3,036,758 issued Mar. 3, 1961; 2,755,748 issued May 4, 1953; and a french patent no. 1,032,266 issued Mar. 25, 1953. Also, a lockbox with a push button mechanism has been available recently which can be bolted to a wall.

In the event an intruder disturbs the slumber of a handgun owner at night, the handgun so protected is of little use. The owner would have to locate the key to the locking mechanism, unlock the locking mechanism (by fumbling around in the dark or turning on a light), load the pistol with ammunition that is probably likewise in a different location, and only then confront the intruder. Even if a type of combination lock were used, the handgun owner would have to use an independent source of light to access the lockbox. Additionally, the lockbox can be easily carried away and subsequently opened.

Also, typical gun lockboxes do not have the flexibility of also being used for a carrying case. A larger safe or strongbox cannot be carried with its owner and used while traveling.

There is substantial interest to millions of handgun owners to not only safely and securely store their handguns, but also have them loaded and readily accessible in the event of an intruder, especially at night. Furthermore, the added utility of being able to safely transport the handgun and use a securing feature while traveling is of great interest.

The features identified above as being desirable for a handgun safety device are all provided by the present invention.

SUMMARY OF THE INVENTION

The present invention is embodied in an improved handgun lockbox that can safely and securely store a loaded handgun of a variety of sizes, yet make it readily accessible in the dark of the night. The invention is extremely economical, completely effective in securing a handgun, partially serves as a carrying case, prevents gun theft and can only be opened by authorized persons. The lockbox can be easily accessed at night by a lighted display which may be activated by touch. Also, the invention can be used to safely transport the handgun, as well as serve its full protective function at a ne location when traveling.

More particularly, the lockbox has a fastener or fasteners which allow it to be locked to any number of standard bed frame supports or the like. This makes the lockbox literally inches away and seconds from use for anyone sleeping in the bed supported by the bed frame. The person in bed need only reach over and activate the lighting means of the lockbox which illuminates an access code pad allowing a code to be selected. Once the code is selected, a latch means can be unlocked which causes the lockbox to separate exposing a consistently oriented and loaded pistol ready for use. By removing the fastener, the lockbox can be used to securely transport the handgun within, using a handle associated with the lockbox.

Also, other applications may also extend to securement of the lockbox within motor vehicles or boats or other locations where a handgun may be needed, but represents a safety hazard.

In more detailed aspects of the embodiments of the invention, the surrounding compartment of the lockbox is made up of two housings forming the lockbox. The handgun is put in the lockbox such that the weight of the handgun contained within may cause the first housing to swing open when the lockbox is unlocked. Also, a gas hinge or tension spring may be used to cause the two housings to separate. The second housing remains attachably and securably fastened to an ordinary bed frame support or the like.

Fastening is achieved by a detachable clip, fastener, bracket, hasp, or other fixative means which may conform to the shape of a variety of different bed frame supports or the like. Alternatively, the clip is securable to the second housing while allowing a mattress to be placed over the clip and the bed frame.

This configuration effectively prevents anyone from taking the lockbox and the enclosed handgun. The clip can be easily and quickly detached from the lockbox by authorized persons. In the invention's transport mode, the clip may also be dissociated from the lockbox.

In another embodiment of the present invention, a similar clip, bracket, hasp or securing means is used to fasten the lockbox in a position, completely under the bed. The lockbox comprises an outer and inner portion. The inner portion slideably moves away from the outer portion when a latching means is actuated. Similarly, an illuminated access panel is readily exposed which allows the latching means to be activated in complete darkness.

In still another embodiment of the invention, similar to the first, the lockbox is modular in design and can be easily secured to a engageable clip which is securable to a stationary object.

BRIEF DESCRIPTION OF THE DRAWINGS

FIG. 2 is a side plan view of the present handgun lockbox of the invention in a closed position, in partial cross section, and attached to a standard bed frame, showing a handgun in phantom line;

FIG. 3 is a top plan view of the handgun lockbox of the present invention, partially open with a portion of the latching means shown in phantom line;

FIG. 4 is a top cross sectional view of the handgun lockbox of the present invention, taken along line 4—4 of FIG. 2;

FIG. 5 is a schematic view of the relationship between the latching mechanism and the lighting circuit to light the access code panel;

FIG 6 is a perspective view of another embodiment of the present invention in an open position;

DESCRIPTION OF THE PREFERRED EMBODIMENTS

Incorporated by reference herein is the disclosure contained in the previously mentioned and allowed application Ser. No. 07/253,581 entitled IMPROVED LOCKBOX AND CARRYING CASE FOR PISTOLS and U.S. Pat. No. 4,788,838 entitled GUARDIAN LOCKBOX FOR PISTOLS, issued Dec. 6, 1988.

Figure 1:
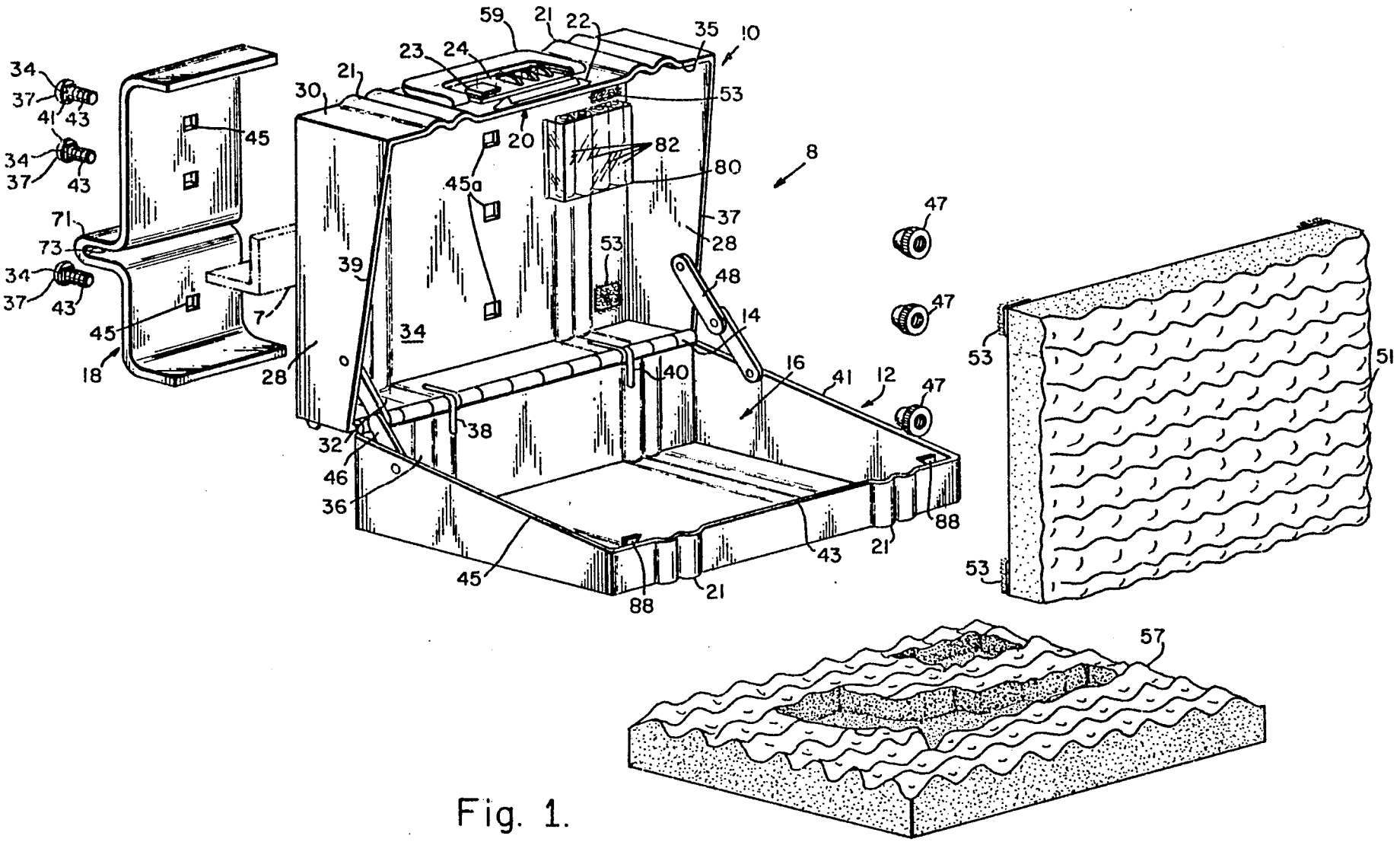
FIG. 1 is an exploded perspective view of the handgun lockbox of the present invention, showing one of the different types of clips which can be used.

Referring to the drawings wherein like numerals of relevance describe like elements throughout and shown in FIG. 1 the invention is embodied in a lockbox of a kind that can be locked onto a standard bed frame support or the like shown in phantom line to safely hold a handgun in close proximity to one lying on a bed as shown in the referred to application.

As shown in FIG. 1, the first embodiment of the present invention, the lockbox 8 includes two almost wedge-shaped housings 10 and 12. A first housing 10 and a second housing 12 is joined by a coupling or hinge means 14 so as to come together and form a compartment 16 within the interior of housings 10 and 12. The lockbox 8 also includes a bracket 18, which releaseably fastens to the first housing 10 to lock the lockbox 8 to the bed frame support.

The housings 10 and 12 are locked together in a closed position by a latching means 20 which can only be operated by the user of the invention knowing a preselected, specific access code. A light means 22 can be activated by touch to illuminate an access code panel 24 where the access code is to be inputed. In FIG. 3, a top view of the latching means 20, access code panel 24 and lighting means 22 is illustrated.

Preferably, the latching means 20 and lighting means 22 can be electronically or mechanically integrated so that a lighting means actuator button or lever 23 actuates the lighting means 22, and subsequently upon further movement opens the latching means 20 once the proper code has been inputed or dialed. Such a possible integration is shown by the schematic in FIG. 5. Although such an integration is not necessary to practice the invention.

A battery housing 80 preferably of plastic retains four AAA sized batteries 82. The battery housing 80 is fixedly attached by glue or rivets to the inside of the first housing 10 while wires 84 run along the interior of the second housing 10 to an area beneath the access code panel 24. At the access code panel 24, the circuit may be completed creating a lighting condition. A lesser power supply such as two AAA batteries could also be effective and a number of different electrical circuitries could be used.

The lighting-latching function can be accomplished using the actuator button 23 which is connected to an actuation bar **23*a* which moves in two directions. The actuator bar 23*a* can move its fully allowable distance when the access code is input allowing such movement as possible by many mechanisms known in the latching art. Movement in one direction locks or opens two side catches 86 which can receivably hold or release tongues 88 located on the opposite and adjacent edge of the second housing 12**.

One catch and one tongue centrally located may be sufficient in other embodiments. An intermediate position of the actuator button 23 closes the electrical circuit shown in FIG. 4, but does not release side catches 86. Therefore, even though the proper access code has not been entered on the access code panel 24, the activator button 23, and actuator bar **23*a* can move a limited distance, closing the circuit and illuminating the access code panel 24**.

In accordance with the invention, as best seen in FIG. 1, the first housing 10 comprises five panels: four sides and a bottom. Two sides 26 and 28 of first housing 10 have a somewhat triangular shape with rounded corners while the other two sides 30 and 32 have a trapezoidal shape with rounded corners. The first rectangular side 30 is wider than the second rectangular side 32 while the bottom 34 is rectangular having the greatest area of all the panels. The panels making up the sides 26, 28, 30 and 32 and bottom 34 are at right angles to their adjacent panels and are sufficiently large so when assembled together form half of a compartment in which a handgun will fit.

For more secure construction, the second housing 12 may be constructed of a slightly smaller size so that the second housing 12 may partially fit within the first housing 10. This construction helps prevent the two housings 10 and 12 from being pried apart.

The panels 26, 28, 30, 32 and 34 are made of a strong durable material, preferably sheet metal, hard plastic, or made of some other material of sufficient strength and so fastened together to prohibit breaking under extreme force. Specific areas of the panels may be made thicker or have additional reinforcement materials at points most likely to encounter greater stress.

The edges where the panels 26, 28, 30, 32 and 34 come together are rounded for style and for safety. Rounded corners are less likely to cause injury in the event one accidentally bumped into the installed lockbox 8. The second housing 12 is of similar construction and material. The hinge means 14 joins the first housing 10 along its smaller rectangular side 32 and the second housing 12 along its larger rectangular side 36. The housings can rotate with respect to each other around the hinge means 14 to bring the exposed edges of all panels not in contact with complementary panels of both housings together.

When the edges 35, 37 and 39 of the first housing 10 are in contact or overlapping proximity with the complementing edges 41, 43 and 45 of the second housing 12, an interior chamber 47 is formed of sufficient size to hold a handgun, not shown, within. In the preferred embodiment, the second housing 12 is of a size which allows the housing 12 to recess into the first housing 10, thereby making unauthorized access even more difficult.

When the lockbox 8 is in an upright position as shown in FIG. 2, the weight of the handgun on the second housing 12 may cause the second housing 12 to rotate about the first housing 10 when the housings are not latched together. This effectively causes the lockbox 8 to "pop open" when the latching means 20 is unlocked. The "pop open" action may be accentuated by the use of tension springs 38 and 40. The tension springs 38 and 40 are held in position by the hinge means 14 commonly known in the art of tension springs. The two tension springs 38 and 40 are located along the hinge means 14 and exert force along the two panels 32 and 36 joined by the hinge means 14 pushing the two housings 10 and 12 apart.

In FIG. 2 the phantom lines of a handgun show the position of the handgun within the chamber 47 formed by both housings 10 and 12. Also, shown in FIG. 2 is the bracket 18 joined to the larger rectangular side 30 of the first housing 10. The bracket 18 is removably secured to the side 30 by three bolts 37 which have rounded heads 39, square shanks 41 and extending threading 43. In other embodiments one bolt may be sufficient. The rounded heads insure that the bolts are nonobtrusive when fastened to the side 30. The square shanks 41 allow the bolts 37 to pass through square slots 45 in the bracket 18 and the square slots 45*a* in the rectangular side 30. The orientation of the slots 45 and 45*a* allow the bracket to be securely held to the rectangular side 30 via the bolts 37. Enlarged nuts 47 with knurled surfaces 49 engage the threading 43 of the bolts 37.

The bolts 37 are positively held in the square slots 45 and 45*a* by their square shank 41. The nuts 47 may be easily threaded onto the bolts 37 without having to hold the bolts 37 since their square shanks 41 are positively held in the square slots 45 and 45*a*. In use the bracket 18 may be one of several types, one is shown in FIG. 1, and is positioned around the bed frame support or removed from the bed frame support 7.

The bracket 18 is of a contoured shape to allow it to come in contact with the bed frame support 7 touching and holding the frame between the bracket 18 and the first housing 10. The bracket 18 is bent at its midsection 71 such that it makes a right angle along its length, extends a distance which may vary depending upon the bracket used (depending upon the bed frame encountered), and makes another right angle along its length. A byte 73 created by the bracket's shape may be varied for different bed frames encountered.

To install the lockbox 8 to a bed frame, the first and second housings 10 and 12 are held in an open position. The rectangular side 30 of first housing 10 is held flush against the bed frame support 7. A variety of different brackets may be chosen depending upon the bed frame support 7. Assuming the mattress and box springs are taken off the bed frame, the bracket 18 can be fitted around the bed frame support 7 and engage the exposed surfaces of the lockbox 8.

Foam padding 51 used within the first housing 10 is removed to expose the square slots 45 in the rectangular side 30. The bolts 37 are pushed through the square slots 45 of the bracket 18 and the square slots 45*a* of the rectangular side 30. The nuts 47 are threaded onto the bolts from the inside of the first housing 10. The padding 51 can then be repositioned within the first housing 10. The padding 51 can be fixedly held using velcro 53 or the like for easy removal and subsequent replacement within the first housing 10.

The first and second housings 10 and 12 may have two other mutually shared hinges 46 and 48 which attach to the opposing trapezoidal sides of each housing. The shared hinges 46 and 48 are comprised of metal tabs each joined together to rotate about a common area on one end and their other end joined to both housings about midway between the end of the housings' trapezoidal sides. The design of these hinges 46 and 48 is commonly known in the art of hinge design.

The shared hinges prevent the second housing from rotating about the first hinge means more than a predetermined degree. The predetermined degree is established so that the second housing 12 will be about perpendicular to the first housing 10 when the lockbox 8 is in its furthest most open position. Strings or flexible tabs, not shown, may also be used instead of hinges.

The lighting means 22 when activated casts light on the access code panel 24. As shown in FIG. 5 of the parent application, incorporated by reference, the lighting means comprises a light bulb 50, a light bulb holder 52, a lens 54, batteries 58, and a contact spring 60 connected to a contact surface 62. The bulb 50 and lens 54 extend above the access code panel 24 wherein the bulb 50 is within the lens 54. The bulb 50 when lighted shines out through the lens 54 to light the access code panel 24.

In this embodiment light is cast onto both the access panel 24 and into the interior of the second housing 12 in a open position. The construction of the lens 54 allows light to not only open the lockbox 8, but also see any contents therein when opened. The lens 54 may be of red tint so as not to blind the operator in total darkness. Furthermore, a light deflector 72 shades light from shining directly into the operator's eyes.

The light is activated by the touch of the access code panel 24 with the hand or by activation of the actuator button 23 as previously discussed. Furthermore, the lighting means 22 may be recessed into the access code panel 24 to properly light the panel without being extended above the top panel 30.

The inside surface 47 of the second housing 12 may be entirely fitted with a soft material 57, such as foam rubber contoured to the shape of the handgun. This material 57 may be glued or otherwise fastened within the secured housing 12. This helps hold the handgun in a stable position within the lockbox 8, as well as to protect the handgun from scratches. Finally, a carrying handle 59 may be permanently or releaseably secured to the top panel 30 of the lockbox 8.

As shown in FIG. 6, another embodiment of the invention uses a similar bracket 61 or to fasten a lockbox 63 of slightly different configuration to a bed frame support 69 shown in phantom line. When secured to the bed frame support 7, the lockbox 63 is located under the bed, as opposed to along side the bed. Only the access panel 24 and lighting means 57 is exposed from beneath the bed.

Similarly, the bracket 61 conforms to the shape of the bed frame support which may have an "L-shape" as shown or a larger byte 73 having a square shape in another configuration. Additionally, a securable hasp means which is hingedly mounted to the lockbox 63 may be used similar to the hasp disclosed by U.S. Pat. No. 4,788,838 or other locking device.

The lockbox 63 functions exactly like the other above-described embodiments, except that the hinge means 14 is replaced by a sliding roller means 65. Also, the shapes and sizes of the first and second housings 10 and 12 are such that the second housing 12 can slideably move into and out of the first housing 10. The action is similar to a drawer, except that the sliding roller means 65 is under tension from a spring means 67 to similarly cause the lockbox to have a "pop-open" action.

Also, it should be noted that the lighting means 57 and access code panel 24 are located on a rectangular side 69 of the first housing so as to be properly exposed when fastened to the bed frame support 7.

Figure 7:
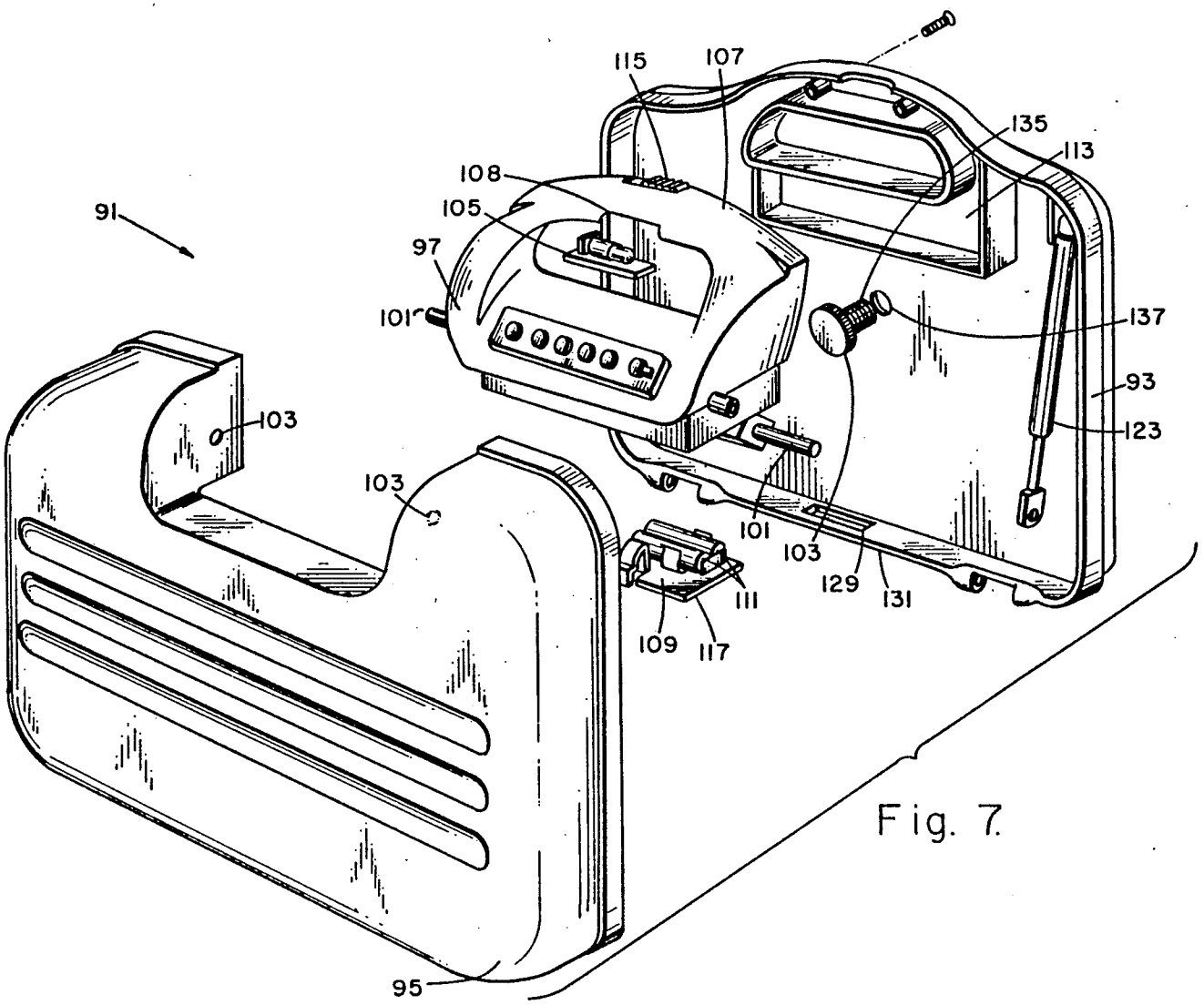
FIG. 7 is an exploded perspective view of a third embodiment of the invention.
Figure 8:
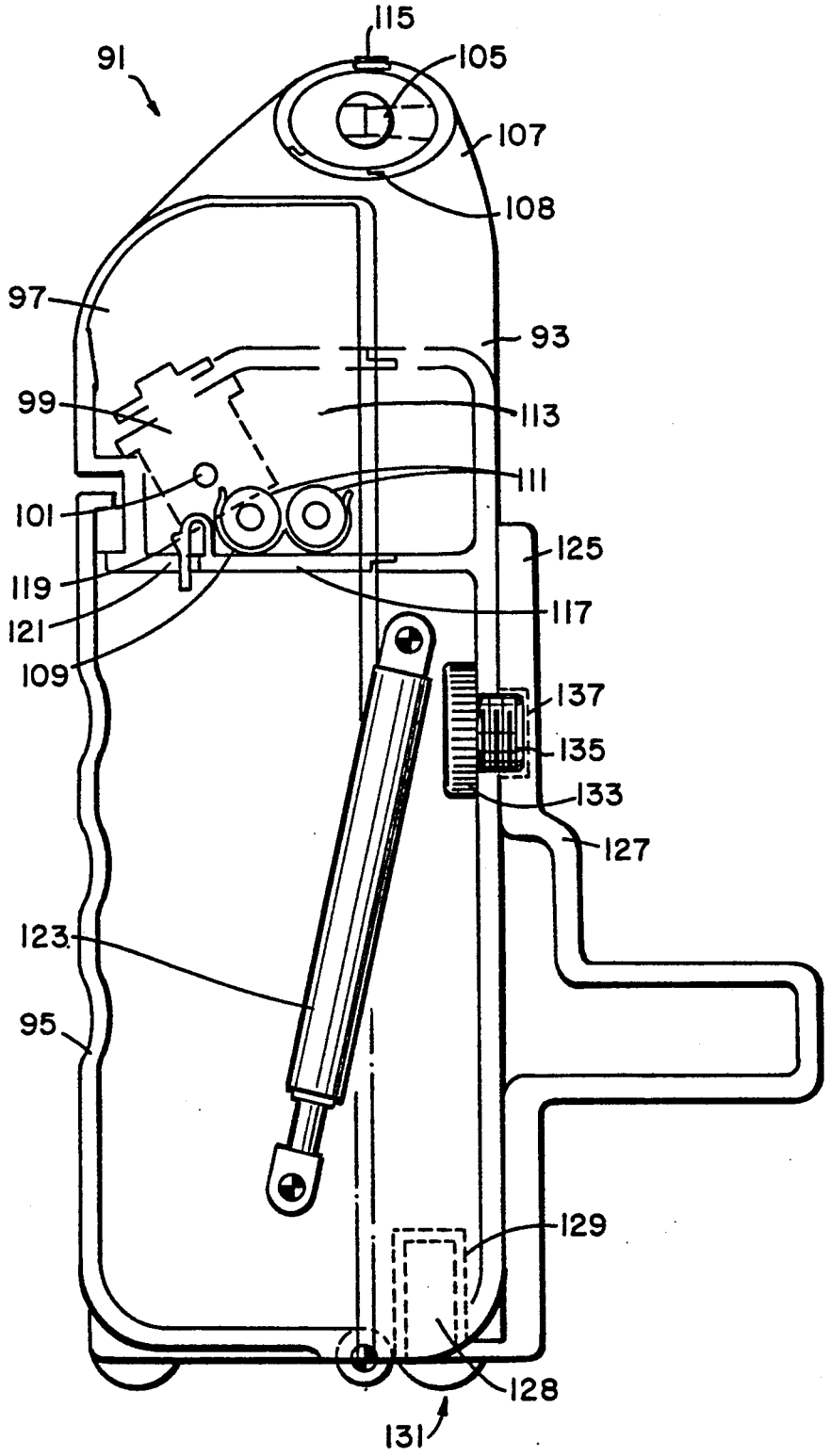
FIG 8 is a right side elevational view in cross-section of the third embodiment of the invention as shown in FIG. 7.
Figure 9:
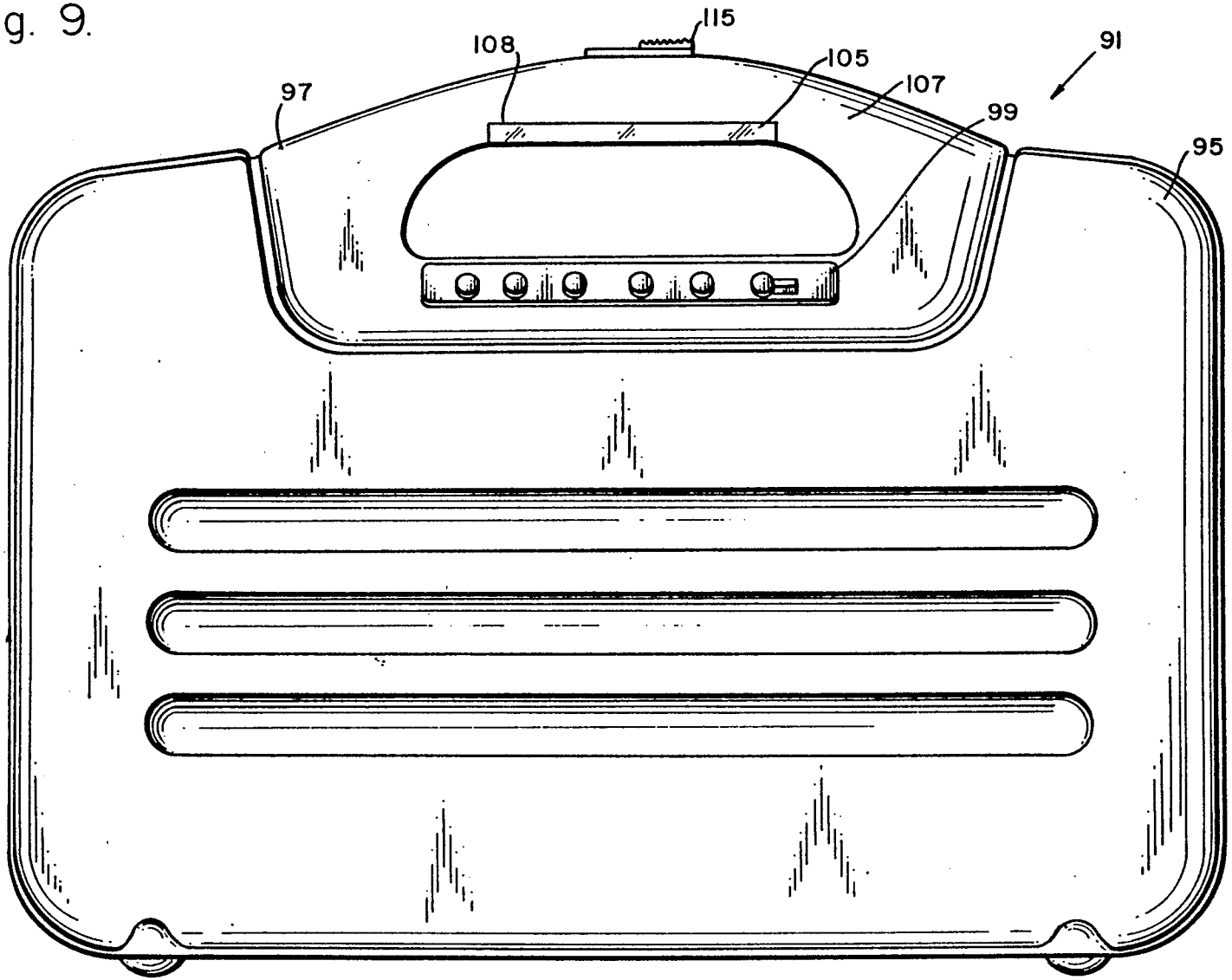
FIG. 9 is plan top view of the third embodiment of the invention as shown in FIGS. 7 and 8.

In a third embodiment of the invention as shown in FIGS. 7–9, the lockbox 91 comprises a securable housing 93, a movable housing 95, and a lock housing 97 which may be preferably molded of a high strength ABS plastic, a polycarbonate vacuum formable lexon plastic, Kevlar, or other durable material. Ideally, the lockbox 91 should be dimensioned as 12 inches long, 8 inches high and 3 inches deep for sleekness, portability and accommodating many types of pistols.

The movable housing 95 is hingedly fastened to the securable housing 93. Many type of hinge means are possible including a piano type hinge, a integrally molded component hinge or other kinds thereof. The lock housing 97 can be sonically welded, screwedly secured or adhesively glued to the securable housing 93 with a push button-type locking mechanism 99 therebetween and retained thereby.

Such a type of looking is a Simplex® "Tuch'But'n Cabinet Lock", model no. 966 SMC made by Simplex Security Systems, Inc. Two throw bolts 101 can engage ports or recesses 103 (one of which is shown in phantom line in FIG. 7) to engage and lock the movable housing 95 to the locking housing 9 and the securable housing 93.

A lighting means 105 as heretofore described can be incorporated in a molded handle portion 107 formed by the lock housing 97 and the securable housing 93 with wires (not shown) connecting to a battery pack 109 with batteries 111 which can be recessed within a region 113 formed between the locking housing 97 and the securable housing 93. The lighting means 105 can be screwedly held within the handle portion 107 and yet be removed from the handle portion 107 through a light projection slot 108.

The handle portion 107 is integrally molded as part of the securable housing 93 and the lock housing 97 and has a geometry so as to be slightly off-center to allow light to adequately shine from the light projection slot 108 to the exposed locking mechanism 99.

The wires(not shown) provide an electrical connection between a switch 115, the battery pack 109 and the lighting means 105. In this embodiment no association is made between the lighting means 105 and the locking mechanism 99 and both operate independently thereof. The switch 115 is shown located on the top of the handle portion 107. However, the switch 115 could also be positioned on an underside of the handle portion 107.

The battery pack 109 and batteries 111 are mounted on a hinged tab 117 with a flexible lip 119. The tab 117 can hold the battery pack 109 and batteries 111 within the region 113 within the lock housing 97 since the lip 119 can engage peripheral walls 121 of the lock housing. Therefore, both the lock mechanism 99 and the batteries 111 or battery pack 109 can be removed or replaced.

A gas spring 123 can be incorporated instead of a tension spring to cause the lockbox 91 to automatically open in a controlled manner when the locking mechanism 99 is opened. The gas spring 123 is positioned between the securable housing 93 and the movable housing 95 and off to one side to prevent interference with the positioning of a handgun (not shown) within. Ideally, the gas spring 123 could be loaded with about 10 pounds of pressure to insure proper opening of the lockbox 91.

A securing bracket, hasp or clip 125 is similar to the brackets and hasps of the heretofore disclosed or incorporated by reference securing means, except for those differences as shown in FIGS. 7 and 8 and those known in the fastener or securing art. The clip 125 may include an additional bend 127 to more aptly conform to the traditional "L"-type bed frame support(not shown). However, such a configuration is not necessary for other conformable brackets or clips when other bed frame types are encountered.

Also, the clip 125 includes an upstanding protuberance 128 (shown in phantom line in FIG. 8) which snugly fits within a slot 129 (also shown in phantom line in FIG. 8) which is formed within an underside 131 of the securable housing 93. The slot 129 may be appropriately reinforced to provide greater retention between the clip 125 and the securable housing 93.

A bolt or securing means 133 has a threaded end 135 or other fastening system to engage the clip 125 through a hole 136 in the securable housing 93 at a centrally located attachment point which may be a complementarily threaded opening 137. Ideally, the securing means 133 would be of the kind which can remain fastened to the interior of the securable housing 93 an yet engage and disengage the clip 125 by rotating the securing means 133 or by some other means known in the fastener art.

Both the clip 125 and the securable housing may be reinforced at their respective points of association thereto. Although the clip 125 is shown associating the securable housing 93 on a particular side, the securable housing 93 could be attachable at other points such as its underside provided a proper fastening device is incorporated thereof.

A foam lining as shown in the other embodiments can be incorporated with a hole(not shown) therethrough to provide access to the securing means 133. Therefore, the foam lining(not shown) can be permanently adhered to the inside of the lockbox 91.

It should be appreciated from the foregoing description that the present invention provides an improved and portable gun lockbox, which also serves as a carrying case. It is simple in construction, yet completely effective in securing a loaded handgun, preventing it from being carried away, and allowing quick access to authorized persons, even at night. Moreover, it can serve as an ordinary carrying case for a handgun when not locked to a bed frame support or the like and subsequently and easily installed when traveling to secure its securing function.

Although the present invention has been described in detail with reference only to the presently preferred embodiments, it will be appreciated by those of ordinary skill in the art that various modifications may be made without departing from the essence of the invention and all such modifications are intended to be covered by the appended claims.

I claim:

1. A handgun lockbox to prohibit unauthorized access to a handgun and lock the lockbox to a stationary object, the lockbox comprising:

(a) a coupling means;

(b) a pair of housings coupled together by said coupling means to form a chamber therebetween of sufficient size to hold the handgun and which can be secured together to prevent the unauthorized access to the handgun;

(c) a latch means for latching adjacent sides of said housings to lock the housings in alignment preventing unauthorized access to the chamber therebetween;

(d) a clip means for clipping one of said housings to the stationary object, wherein the clip means is of a length and geometric shape to engage the stationary object and wherein said clip means fixedly attaches to one of said housings to hold the stationary object by said clip means to said one of said housings when in an installed condition.

2. A handgun lockbox as claimed is claim 1, wherein said clip means can be attachably detached from said one of said housings when the lockbox is in an open position.

3. A handgun lockbox as claimed in claim 2, further comprising a lighting means for displaying said latch means in darkness.

4. A handgun lockbox as claimed in claim 3, wherein the housings are of a shape and design such that the weight of the handgun on one of said housings assists one of said housings to rotate about the coupling means opening the lockbox when said latch means is in an open position.

5. A lockbox as claimed in claim 4, wherein said lighting means is independent of said latch means and can be independently actuated thereof.

6. A handgun lockbox as claimed in claim 5, wherein said coupling means includes a gas spring or a means is interconnected between said housings to cause said housings to open when said latch means is in the open position causing the lockbox to open to a predetermined degree.

7. A handgun lockbox as claimed in claim 6, wherein an inside surface of said housings is lined with a soft material which may conform to the shape of the handgun.

8. A handgun lockbox as claimed in claim 7, further comprising a fastening means to engage and hold said clip to one of said housings therebetween when the lockbox is in the installed condition, and wherein said fastening means cannot be disengaged from said clip by unauthorized personnel when the lockbox is in a locked condition.

9. A handgun lockbox as claimed in claim 3, wherein said clip having a first and second end with a byte defined therebetween of a predetermined shape and size to engage a bed frame support having a rectangular or "L" shape.

10. A handgun lockbox or the like comprising the combination, a first and second readily transportable housing member securely coupled and defining therebetween a chamber sufficient in size and configuration to contain a gun or the like; clip means secured to one of said first and second housing member to releasably secure said lockbox to a stationary object and locking means operatively associated with said first and second housing members and adapted to prevent unauthorized access to said chamber, whereby said gun or the like is securely retained within said lockbox.

11. A lockbox as defined in claim 10, wherein the locking means includes a lighting means to light the locking means, wherein the lighting means and the locking means are independently actuated.

12. A lockbox as claimed in claim 11, wherein the coupling means includes a gas spring or the like or a means is interconnected between both housing members to cause the members to separate when the locking means is unlocked causing the lockbox to open to a predetermined degree.

13. A lockbox as claimed in claim 12, wherein the first and second housing members are of a shape and design such that the weight of the handgun or the like on one of the members causes it to rotate about a coupling means opening the lockbox when the locking means is in an open position.

14. A lockbox as defined in claim 13, wherein the inside surface of said housing members is lined with a soft material conformed to the shape of a handgun or the like.

15. A handgun lockbox to prohibit unauthorized access to a handgun and selectively lock the lockbox to a stationary object, the lockbox comprising:

(a) a coupling means;

(b) a pair of housings coupled together by said coupling means to form a chamber therebetween of sufficient size to hold the handgun and which can be secured together to prevent unauthorized access to the handgun, unless the housings are in an open condition, and wherein said housings fit together so that one of said housings releases within said other housing for greater securement of said chamber therebetween;

(c) a latch means for latching together said housings, selectively locking together said housings in alignment, preventing unauthorized access to said chamber therebetween, further comprising an access panel to actuate said latch means, wherein said panel is readily exposed when the lockbox is in an installed condition;

(d) a clip means for clipping one of said housings to the stationary object, wherein the clip means is of a length and geometric shape to engage the stationary object, and wherein said clip means attaches to one of said housings to hold the stationary object by said clip means and said one of said housings when in an installed condition, and wherein said clip means is held to said one of said housings by a fastener which engages said one of said housings and engages said clip means.

16. A handgun lockbox as claimed in claim 15, wherein said coupling means is a hinge, wherein said hinge includes a gas spring to cause said housings to separate when said latch means is actuated by an authorized person creating an open condition.

17. A handgun lockbox as claimed in claim 15, wherein said coupling means is a sliding means for allowing movement of one of said housings in and out of said other housing.

18. A handgun lockbox as claimed in claim 17, wherein said sliding means is under tension allowing said one of said housings to separate from said other housing when said latch means is actuated allowing the lockbox to open.

19. A handgun lockbox as claimed in claim 18, further comprising a soft interior layer which complements the shape of the handgun to be held within, and said clip is shaped to engage a bed frame support.

20. A handgun lockbox as claimed in claim 15, further comprising a means for lighting said panel, wherein said lighting means is selectively actuated by a button which may also selectively actuate said latch means to create said one condition.

21. A transportable handgun lockbox or the like to prohibit unauthorized access to a handgun or the like comprising:

(a) a coupling means;

(b) a pair of housings coupled together by said coupling means to form a chamber therebetween of sufficient size to hold the handgun or the like and which can be secured together to prevent unauthorized access to the handgun or the like, wherein one of said housings is adapted to securably engage another object, yet be easily and selectively dissociated from said another object for transporting said handgun lockbox or the like, and wherein said handgun or the like can be easily accessible when said lockbox or the like is in an open position, and wherein a handle is included on at least one of said housings for carrying said lockbox;

(c) a latch means for latching adjacent sides of said housings to lock said housings in alignment preventing authorized access to said chamber therebetween.

22. A transportable handgun lockbox or the like as claimed in claim 21, further comprising a lighting means for displaying said latch means in darkness.

* * * * *